United States Patent [19]

Rónaföldi et al.

[11] 3,941,088

[45] Mar. 2, 1976

[54] STANDING WAVE METALLIZING APPARATUS FOR COATING A SUBSTRATE WITH MOLTEN METAL

[75] Inventors: Arnold Rónaföldi; István Zoltán, both of Miskolc, Hungary

[73] Assignee: Csongradmengyei Tanacs Vegyesiparm Szolgaltato Vallalat, Hodmezovasarhely, Hungary

[22] Filed: July 15, 1974

[21] Appl. No.: 488,570

Related U.S. Application Data

[63] Continuation-in-part of Ser. No. 302,563, Oct. 31, 1972, abandoned.

[52] U.S. Cl. ..... 118/620; 13/29; 118/429

[51] Int. Cl.[2] ..... B05C 3/12

[58] Field of Search ..... 118/640–643, 118/620, 400, 423, 429, DIG. 19; 117/93.2, 51, 52; 13/26, 27, 26 S, 27 S, 29; 164/1; 228/37

[56] References Cited

UNITED STATES PATENTS

| | | | |
|---|---|---|---|
| 2,529,699 | 11/1950 | Lach | 118/123 |
| 2,539,215 | 1/1951 | Weil et al. | 13/29 |
| 2,648,715 | 8/1953 | Lillienberg | 13/29 |
| 2,702,525 | 2/1955 | Whitfield | 118/423 X |
| 2,721,813 | 10/1955 | Holmberg | 118/400 X |
| 3,726,465 | 4/1973 | Boynton et al. | 118/400 |
| 3,752,383 | 8/1973 | Allen et al. | 228/37 |
| 3,797,724 | 3/1974 | Flury et al. | 228/37 |

*Primary Examiner*—Morris Kaplan

[57] ABSTRACT

Standing-wave metallizing apparatus for coating a substrate with a molten metal of a melting point lower than that of the material of the substrate, comprising a tank with a bath therein for the molten metal, a pump outside the tank for heating the metal and for circulating the same to and from the bath, the pump having a magnetic circuit with an air gap therein, thereby to produce laminar flow of the molten metal in the pump, which results in a standing-wave pattern, by the aid of which the substrate is coated with the molten metal.

7 Claims, 4 Drawing Figures

STANDING WAVE METALLIZING APPARATUS FOR COATING A SUBSTRATE WITH MOLTEN METAL

This is a continuation-in-part application of the applicants' co-pending patent application Ser. No. 302,563, filed Oct. 31, 1972 for "Standing-Wave Metallising Device", now abandoned.

The invention relates in general to standing-wave metallizing apparatus suitable for coating materials or substrates, predominantly material strips such as wires, plates, suspended individual metal objects, with a metal of a melting point lower than that of the basic material or substrate, for instance with tin, lead, zinc, and further for coating boards with solder that are provided with printed circuits and/or for their sealing in the assembled state. This type of apparatus is generally referred to as a standing-wave or wave-soldering device.

At present, devices of various operational systems and constructions are known. For metallizing materials or substrates, devices realizing the immersion or dipping process are used, in which a continuously advancing material is immersed in a metal melt or bath of high thermal capacity, and the immersion is carried out by means of mechanical baffle plates reaching under the surface of the metal melt.

The common drawback of all devices of this type consists in that provision must be made, at the ingress point into and egress point from the metal melt of the advancing material or substrate for the continuous removal of surface oxide and slag layers, and for the prevention of their formation by using intricate structural elements or agressive chemical agents.

In case of melting baths of more than 300° to 350°C working temperature the surface oxide and slag layer practically cannot be removed any more by means of chemical agents (fluxes) applied to the surface. under the same conditions non-metallic by-products (oxides and other slag materials) forming from some components of the metal melt, further vapors of some volatile metals, for instance cadmium, arise in very large quantities and pass into the atmosphere surrounding the working place. The low contamination concentrations permissible by health protection regulations can be achieved only by means of expensive and intricate additional technical solutions, for instance by means of intensive local ventilation. Such ventilation, on the other hand, disadvantageously influences the uniformity in space and in time of the temperature of the metal melt.

The metal leads formed on the insulating panel base of printed boards are usually provided with a solder coating in order to improve solderability. For this purpose, devices employing chemical, electrochemical and pyrometallurgical processes are known. The pyrometallurgical solder application is carried out by means of devices realizing two possible methods for the sealing of boards provided with printed wiring and equipped with components.

The method carrying out the just mentioned simple steps floats the printed boards which are treated with flux, supplied with components or without those, on the surface of a quiescent solder bath and slightly immerses them therein, and then removes them from the bath.

The other, more intricate but more reliable method, realizing more effective steps, passes the empty or the set-in printed boards above the solder melt where a standing-wave pattern is produced with a peak generatrix in such a manner that the wave peaks at least touch and uniformly wet the surfaces to be treated that are passed above it.

In solder applying and/or soldering devices which establish standing waves, a specially developed mechanical metal-melt or solder pump is arranged on the lower part of the electrically heated tank, driven by an electric motor, the pump having generally a rigid motor (centrifugal pump) or a gear pump. The melt delivered by the pump flows through a carefully formed channel to a horizontally arranged exit slit above which the standing-wave pattern with a horizontal peak generatrix or crest is formed due to the delivery pressure of the pump and the inertia of the flowing liquid.

The melt which flows back from the wave returns into the solder melt tank. The replacement of the solder quantities delivered to the workpieces, as well as reduced by the fluxing and spurting, is ensured by means of a separate mechanical or electro-mechanical solder feeder which senses the melt level and operates as a function thereof. The height of the solder melt wave is adjusted by varying with time the delivery volume of the pump, and generally by varying the pump revolution.

These devices have several technological and economic advantages as compared with the dip-process flotation treatment; however, they also have several disadvantageous characteristics. The special mechanical pump requires careful design and production since it must be operated in the solder melt of about 280°C so that it should not cause any turbulence. Such pumps are highly sensitive to the presence of solid contaminants (slag, accidentally detached metal parts, components, etc.) getting into the solder melt, since they may cause jamming, or possibly even failure of the pump.

For hydrodynamical reasons the flow channel requires very careful design. To avoid turbulences caused by the mechanical pump, damping elements built into the channel are required. A separate holding circuit with a temperature sensing device must be provided to prevent the inadvertent switching on of the motor, which drives the mechanical pump through a mechanical gearing, in case the solder is in a solidified state. The maintenance and repair of the mechanical pump are rendered difficult by the fact that it is arranged within the metal melt.

The regulation of the liquid level requires an intricate construction, including a separate mechanical or electromechanical sensing element and a feeder. The temperature gradient in the melt is primarily caused in that the melt is in thermal contact with the electric heater only through thermal conduction. The rotor of the mechanical pump has the same temperature as the solder melt so that its bearing support and drive require trouble-free operation even at high temperatures and do not cause excessive heat dissipation.

It is one of the major objects of the present invention to overcome the disadvantages and drawbacks of the prior-art devices.

The device according to the invention aims at eliminating the drawbacks of known standing-wave soldering devices built with mechanical pumps, and is suitable for new fields of application in a broader temperature range.

The device according to the invention has a further object in ensuring the keeping in motion of the metal melt without any moving parts, by means of an electrodynamic or an induction heating pump providing for a laminar flow of melt in a channel, without directional change from an energy transfer point up to the resulting standing wave. At the same time it realizes continuous automatic level control and self-cleaning without separate feeders, within the utilization temperature range of metals and alloys used for coating and for soldering from a metal melt. The temperature range extends in practice up to about 600°C.

On the surface of the arising metal melt wave, material vibrations can be produced without disturbing the flow pattern and being independent thereof. The vibration increases the degree of wetting at the contact points between the materials and the metal melt, and effectively promotes the elimination of surface contaminants inhibiting the wetting.

The temperature distribution in the metal melt is highly advantageous since its heating is carried out by induction and/or by the current flowing in the melt, and also because the employed electrodynamic or induction heating pump has no heat dissipating parts. The pump participates in the heating up of the metal and then in the maintaining its operating temperature. Its repair is possible both in the cold and the warm state of the metal since the structural parts necessitating repair are arranged outside of the metal melt.

The inside of the device according to the invention can be considerably smaller than that of conventional pump-type devices of the same capacity since the volume of the metal melt tanks is not increased unnecessarily by the space requirement of mechanical pumps.

Consequently, only a relatively small quantity of metal melt needs to be held in the device according to the invention, which results in energy saving in the heating up and in material costs, as compared with the compulsory periodic changes of the metal melts in the prior art, necessarily contaminated with foreign metals during the operation.

In the device according to the invention, the ratio of surface area (volume of the melt contacting the ambient air) is considerably reduced, which limits the amount of slag and oxide formation and renders possible an effective protection of the entire free surface, with only a small quantity of a protecting agent, for instance fluxing salt or oil.

The structure of the flow channel of the electrodynamic or induction heating pump affords a simple possibility for feeding the protecting agent and the flux below the metal melt level, used successfully with some known standing-wave soldering devices.

The channel of the heating pump delivers the metal melt exclusively from the lowest part of the tank to the exit slit, so that contaminants having a lower specific weight than that of the metal melt cannot enter into the channel. Solid metal particles that may possibly get into the channel do not cause failures, as against those experienced with mechanical pumps, and can be removed even during operation.

The pump delivers the metal melt from a given level, thus periodic level variations, unavoidable with mechanical or electromechanical solder feeders, do not occur since such variations are the consequence of a periodic metal supply.

The subject matter of the invention is a device for coating materials or substrates, particularly material strips, such as wires, plates, suspended individual metal objects, with a metal of a melting point lower than that of the basic material or substrate, for instance with tin, lead, zinc, and further for coating with solder of boards provided with printed circuits and/or for their sealing in the assembled state, comprising, according to the invention, an electrodynamic or an induction heating pump incorporating a working or main channel and an auxiliary channel.

The invention will now be described in greater detail with reference to the accompanying drawings, which show an exemplary, preferred embodiment of the coating or standing-wave metallizing apparatus according to the invention. In the drawings, FIG. 1 shows a cut-open, exploded view of the standing-wave metallizing device according to the invention during its operation;

Figure 3:
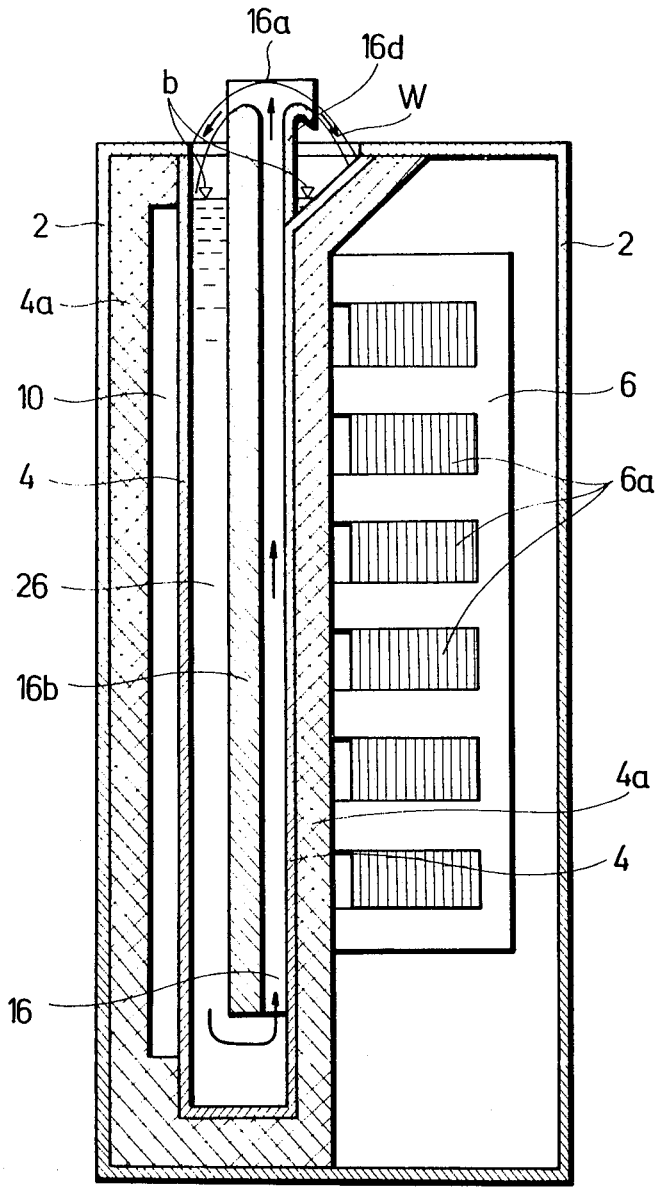
FIG. 3 is a perpendicular sectional view taken on the line III — III of FIG. 1.

In a casing 2 of the inventive standing-wave metallizing apparatus a metal melt tank 4 is arranged, made of non-magnetic steel and covered with heat insulation 4a. A laminated iron core 6 with a three-phase electric winding 6a thereon constitutes an induction heating pump together with a ferromagnetic, solid cover constituted by plates to be described somewhat later. A schematically illustrated electric radiator 10 (FIGS. 1, 3) maintains the metal melt in the tank 4 at the desired temperature, which latter is controlled by a sensing element 12. A schematically shown control box 14 has electric current running to the three-phase winding 6a, radiator 10, temperature sensing element 12, and of course to the mains. In the control box 14 a temperature regulator and a unit controlling the pump delivery head are also arranged.

Figure 1:
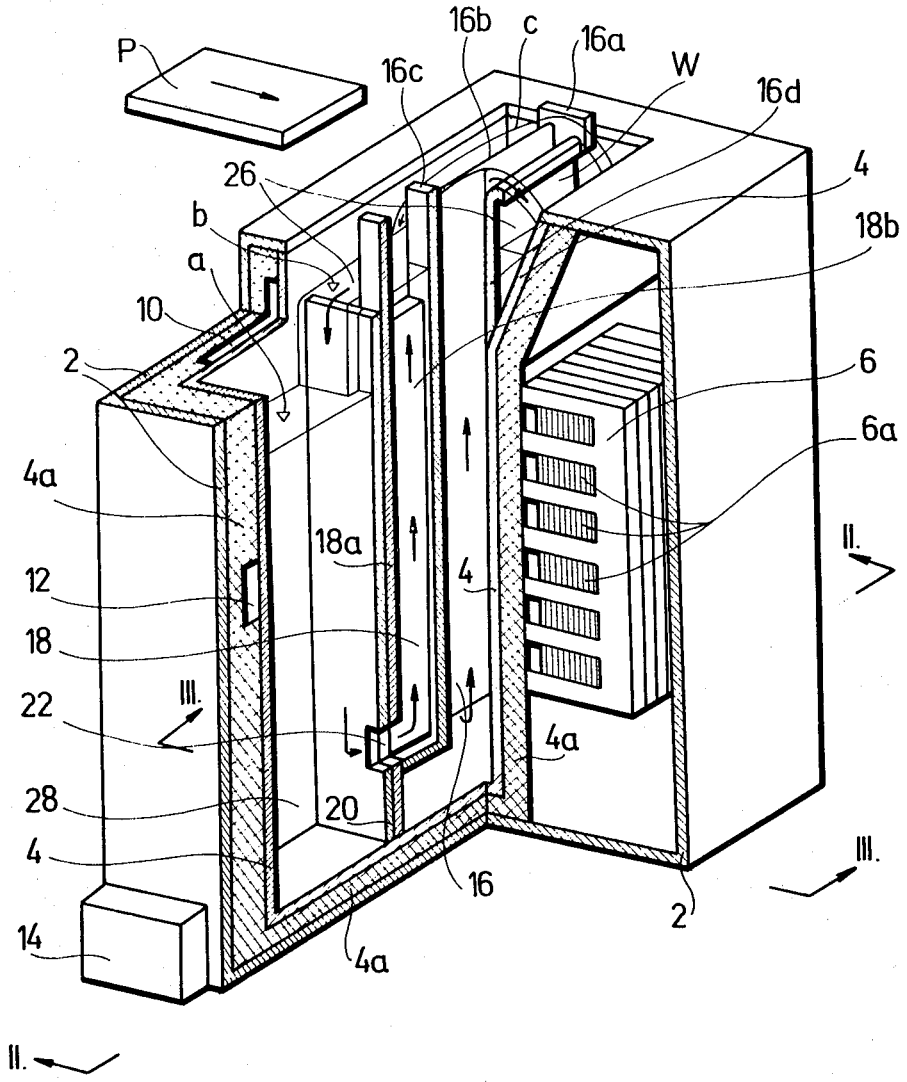
Figure 2:
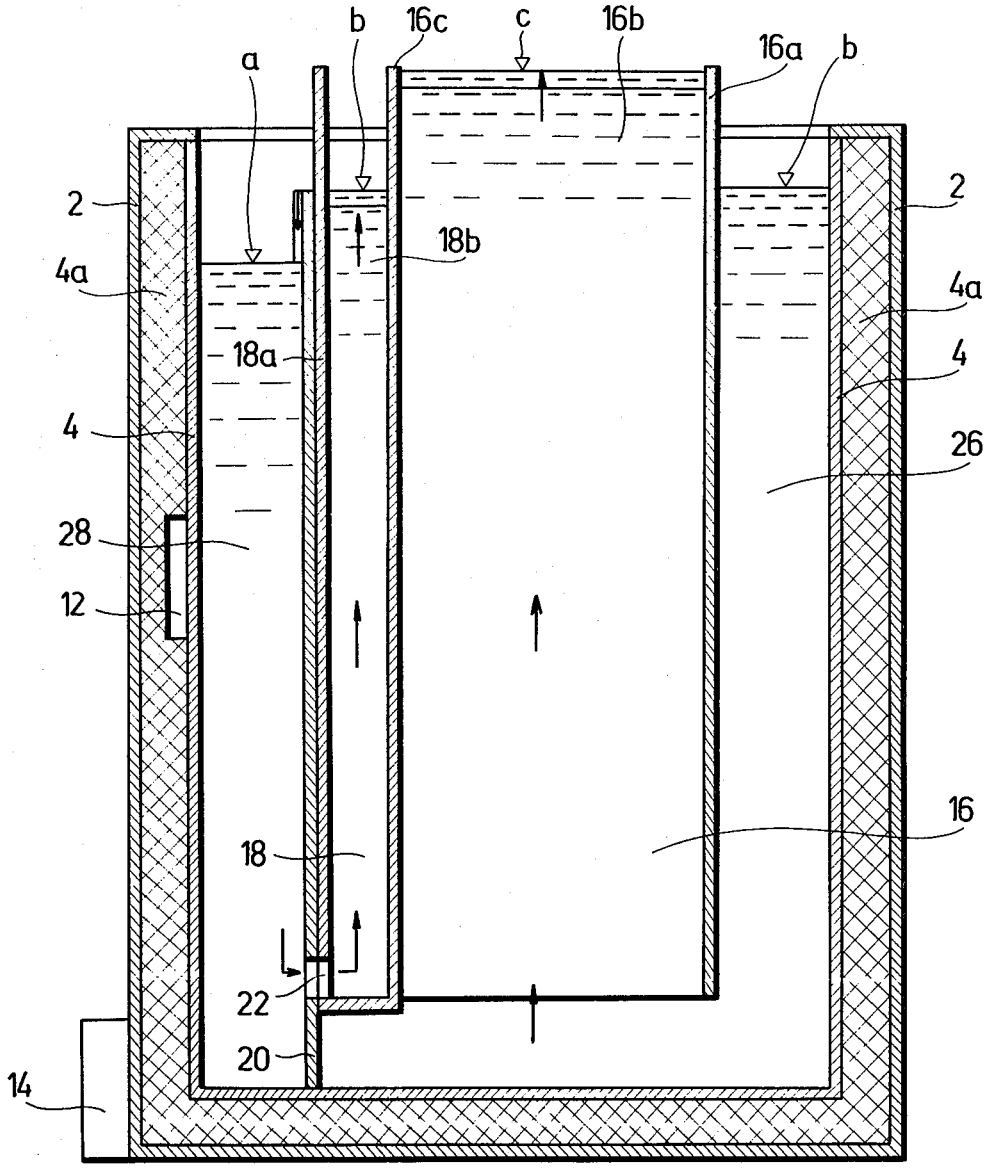
FIG. 2 is a transversal section taken on the line II — II of FIG. 1.
Figure 4:
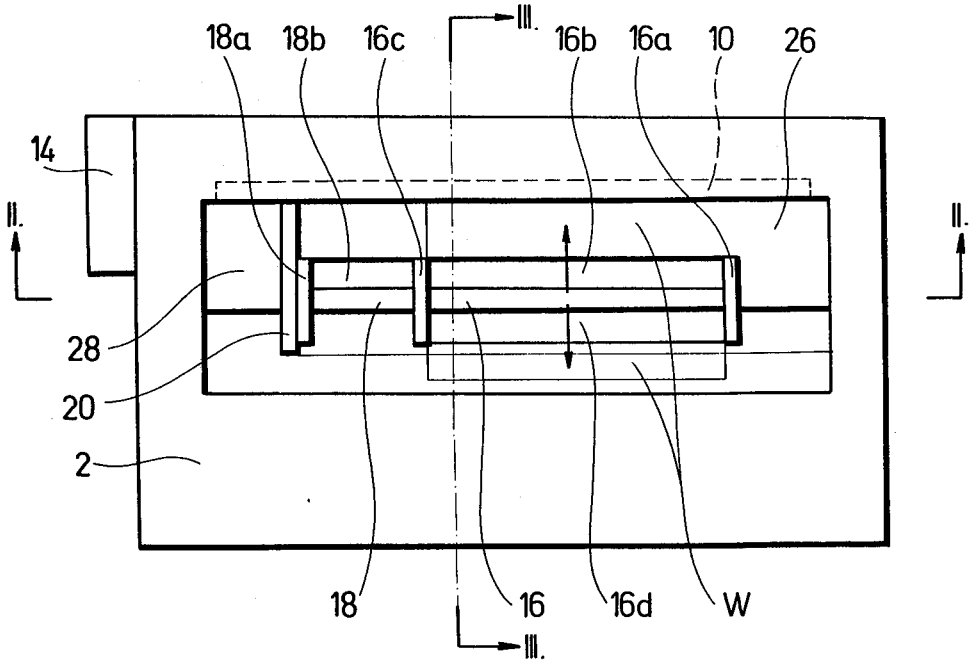
FIG. 4 is a top plan view of the apparatus.

The ferromagnetic cover is made up of space-limiting plates 16a, 16c which form a working channel 16 (see FIG. 2), flanked in the transversal direction by elements **16*b*, 16*d*, as shown in FIG. 1, which have preferably bent-down top terminal portions. An auxiliary channel 18 is defined in the tank by further ferromagnetic cover elements 18*a* and 18*b* (see FIGS. 2 and 4), the third side being constituted by the eariler-described plate 16*c*. A level controlling dam 20 determines and stabilizes the upper level of the metal melt in a working tank 26.**

The inside of the device according to the invention can be considerably smaller than that of conventional wave-soldering devices of the same capacity, provided with mechanical pumps, since the volume of the metal-melt tanks is not increased unnecessarily by the space requirement of the pumps.

The metal melt discharged from the working channel 16 forms a wave W which is made to contact the workpiece P (printed circuits and the like) that is or are moved continuously above the metal wave W.

on the surface of the arising metal-melt wave (see in FIG. 2 at *c*, to be described hereunder), material vibrations can be produced without disturbing the flow pattern and being independent thereof, namely within a range of about 50 – 300 Hz. The vibration increases the degree of wetting at the contact points between the materials and the metal melt, and effectively promotes the elimination of surface contaminants inhibiting the wetting.

An air gap is arranged between the iron core 6 of the three-phase winding **6*a* and the ferromagnetic cover-plate elements 16***b*, 18*b*. The part of the air gap which contains the metal tank 4 and also the heat insulation 4*a* forms the working channel 16 and the auxiliary channel 18, which are filled with the molten metal during the operation of the device.

It might be added at this point that the cover-plate elements perform a double role in that they also serve to flank or limit the just mentioned working and auxiliary channels 16, 18, besides constituting the plates which close the respective magnetic areas.

The induction heating pump lifts the metal melt up to the arrowhead-marked limit *c* (mentioned before) in the working channel 16, which limit is higher than the similarly marked constant upper level *b* of the channel 18 and the tank 26. The melt leaving the working channel 16 forms a standing-wave pattern with a horizontal peak generatrix or crest at *c* and returns into the tank 26 (see FIG. 3). It should be noted that in FIG. 2 the horizontal line just below the limit *c* denotes the actual upper edge of the cover plate 16b. The delivery head of the induction heating pump can be adjusted by conventional field regulation.

The induction heating pump delivers the metal melt to the working tank 26 also through an opening 22 from an auxiliary tank 28 into the auxiliary channel 18, thus ensuring the replacement of the metal loss. In the auxiliary tank 18, the arrowhead-marked melt level is shown at *a*. The surplus metal melt pumped through the auxiliary channel 18, flowing over the dam 20, returns into the auxiliary tank 28, in which the melt level *a* continuously decreases, corresponding to the amount of the metal used up in operation. After a greater drop the auxiliary tank 28 is refilled.

Only a relatively small quantity of metal melt needs to be held in the device according to the invention, which results in energy saving in the heating up, and in savings in material costs as compared with the unavoidable periodic changes of the metal melts in the prior art, which necessarily become contaminated with foreign metals during the operation.

The channel of the heating pump delivers the metal melt from a given level, namely exclusively from the lowest part of the tank to the exit slit, so that contaminants having a lower specific weight than that of the metal melt cannot enter into the channel. Solid metal particles that may possibly get into the channel do not cause failures, as against those experienced with mechanical pumps, and can be removed even during operation. Periodic level variations, unavoidable with mechanical or electro-mechanical solder feeders, do not occur since such variations are the consequence of a periodic metal supply.

Most part of the contamination, such as slag, oxide layer, floating on the surface of the metal melt in the working tank 26, flows over the dam 20 and reaches the auxiliary tank 28 wherefrom it cannot return to the originating point, namely tank 26. In this way the apparatus according to the invention is effectively self—cleaning. Discharge openings can of course be provided for slag, e.g. at the bottom of the tank 28.

In the device according to the invention, the ratio of surface area (volume of the metal contacting the ambient air) is considerably reduced, which limits the amount of slag and oxide formation and renders possible an effective protection of the entire free surface, with only a small amount of protecting agent, for instance fluxing salt or oil.

The structure of the flow channel of the pump affords simple means for feeding the protecting agent and the flux below the metal melt level, used successfully with known standing-wave soldering devices.

The induction heating pump of the described exemplary embodiment combines in itself the functions, without a single moving part, of a driving motor, gear transmission, mechanical metal melt pump, channel provided with damping elements, mechanical or electromechanical solder feeder, all needed in the known soldering devices.

The currents flowing in the solid cover-plate elements 16..., 18... of the induction heating pump, as well as in the working and auxiliary channels 16, 18, provide the basic heating. On adjusting a pulsating-advancing magnetic field, vibration occurs on the surface of the metal wave at *c*, which breaks up any oxide layer that may form thereon. The automatic level control ensures simultaneously self-cleaning of the melt.

The inventive arrangement constitutes a magnetic circuit for the pump, including the explained air gap, thereby to accomplish the advantageous and novel features of the inventive apparatus.

The temperature distribution in the metal melt is most favorable because its heating is carried out by induction and/or by the current flowing in the melt, and also because the employed pump has no heat dissipating parts. The pump, switched on in the cold state, participates in the heating up of the metal and then in the maintaining its operating temperature. Its repair is possible both in the cold and the warm state of the metal since the strujtural parts necessitating repair are arranged outside of the metal melt.

The above-described and illustrated embodiment is exemplary of the inventive device. Within the scope of the invention several other embodiments are of course possible.

So, for instance, the described induction heating pump can be replaced by a pump operating on electrodynamic principles, in which a permanent transporting agent for the molten liquid metal can be maintained in consequence of the mutual effect of the current carried by electrodes into the melting liquid, on the one hand, and of a magnetic field through the melt, on the other.

The standing-wave metallizing device according to the invention ensures the keeping in motion of the metal melt without any moving parts, by means of the appropriate pump means, producing a laminar flow of the melt in the channel, without directional change from the energy transfer point up to the described standing wave. At the same time it realizes continuous automatic level control and self-cleaning without separate feeders, within the utilization temperature range of the metals and alloys used for coating and for soldering from a metal melt. This temperature range extends in practice up to about 600°C.

It should be understood, of course, that the foregoing disclosure relates only to preferred embodiments of the invention and that it is intended to cover all changes and modifications of the examples described which do not constitute departures from the spirit and scope of the invention.

What we claim is:

1. A standing-wave metallizing apparatus for coating a substrate with a molten metal of a melting point lower than that of the material of the substrate, comprising; a tank, a bath for the molten metal; pump means outside said tank for heating the metal and for keeping it in circulatory motion to and from said bath; said pump means including a magnetic circuit and a laminated iron core also outside said tank, with an air gap in said core; and means in said tank including a working channel and an auxiliary channel for producing laminar flow of the molten metal in at least a portion of said pump means said channels being in part defined by ferromagnetic covers, said air gap including said covers, said working channel and in part said auxiliary channel, at least part of said channels and the laminar flow toward a top level of the molten metal, resulting in a standing-wave pattern above the top level, by the aid of which pattern the substrate is coated with the molten metal at the top level, without immersing the substrate in the molten metal.

2. The metallizing apparatus as defined in claim 1, further comprising means for feeding a protecting agent and the like through a flow channel below the level of the molten metal.

3. The metallizing apparatus as defined in claim 1, wherein said pump means is electrodynamically operated.

4. The metallizing apparatus as defined in claim 1, wherein said pump means is inductively operated.

5. The metallizing apparatus as defined in claim 1, further comprising partitions which define at least one of said channels.

6. The metallizing apparatus as defined in claim 1, further comprising a level-controlling dam in said tank to define a predetermined upper level of the molten metal in at least one of said channels.

7. The metallizing apparatus as defined in claim 1, further comprising means for delivering the molten metal from a lower portion of said auxiliary channel into said working channel to replace material losses.

* * * * *